US005676252A

United States Patent [19]

Lillelund et al.

[11] Patent Number: 5,676,252

[45] Date of Patent: Oct. 14, 1997

[54] CARRIER FOR PASTRY

[75] Inventors: Stig Lillelund, Gentofte, Denmark; Robert H. C. M. Daenen, Essene, Belgium

[73] Assignee: Dart Industries Inc., Orlando, Fla.

[21] Appl. No.: 679,359

[22] Filed: Jul. 11, 1996

[51] Int. Cl.[6] ..... A45C 11/20

[52] U.S. Cl. ..... 206/551; 220/212.5

[58] Field of Search ..... 206/551, 557, 206/769, 771; 220/212.5, 326, 574

[56] References Cited

U.S. PATENT DOCUMENTS 4,179,039 12/1979 Kawolics ..... 220/212.5

4,375,862 3/1983 Kurinsky et al. ..... 220/212.5

4,648,512 3/1987 Tarozzi et al. ..... 206/541

5,577,779 11/1996 Dangel ..... 220/326

*Primary Examiner*—Jacob K. Ackun

*Assistant Examiner*—Nhan T. Lam

*Attorney, Agent, or Firm*—John A. Doninger

[57] ABSTRACT

A carrier for pastry including a tray and a cover selectively engageable over the tray. A handle integrally formed with the tray has opposed depending end portions releasably locked within opposed slots in the tray. Latching projections are provided on each end of the handle and are releasably locked into position by sliding locking collars cam biased to releasably fix the latching projections in locking position.

16 Claims, 3 Drawing Sheets

18
48
46
74
50
78
60
30
52
26
24
20
22
14
42
44
51
29
28
16
38
4
5

CARRIER FOR PASTRY

BACKGROUND OF THE INVENTION

The invention broadly relates to covered pastry carriers of the type utilizing a tray directly receiving the foodstuff and a separate dome-like cover received over the tray with the cover frequently secured to the tray in some manner. A handle may also be provided with the handle crossing over the cover and having the opposed ends thereof secured to opposite sides of the tray. Such handles may in fact comprise the means for retaining the cover on the tray.

Such carriers, while commonly used, are frequently less than satisfactory for a variety of reasons. For example, inasmuch as the tray may carry a relatively heavy load, for example, a cake or cheeses, it is importanat that a positive lock be provided between the cover and tray, or handle and tray, to prevent accidental disengagement and to maintain a stable relationship between the tray, cover and handle. This in turn usually requires a rather elaborate locking system which is difficult to manipulate and is incompatible with the basic requirement that the cover be both easily mounted and easily removed.

SUMMARY OF THE INVENTION

The pastry carrier of the invention significantly improves over generally similar prior art items through a variety of interrelated features which result in a highly stable assembled carrier with substantially no possibility of accidental release of the handle or cover from the tray during use, while at the same time providing for convenient controlled release by simple manual manipulation. Once released, the handle and cover are removed as a unit from the tray, utilizing one hand, and leaving the other hand free for dispensing the foodstuff from the tray. This allows for a convenient reclosing of the tray with latching ends on the handle automatically engaging with the tray.

Basically, the handle is formed integral with the cover and includes, at diametrically opposed portions of the cover, free latching handle ends which engage within keeper slots at diametrically opposed portions of the tray. Upon engagement of the handle ends within the slots, a single locking collar on each handle end portion is slid downwardly to laterally cam the corresponding handle end into a locked position relative to the tray whereby release of the latched handle ends can only be effected by a positive manual upward sliding of the locking collars.

By forming the handle integral with the cover, it will be appreciated that the handle can be used to carry the entire carrier, that is the tray and cover when loaded with foodstuffs, and also can be used as a means for handling, removing and repositioning the cover relative to the tray.

The tray itself is invertible, having on one planar face a shallow, smooth peripheral rim allowing for an easy positioning of a cake thereon as well as for subsequently cutting the cake. On the other face, the tray is provided with a relatively high rim particularly adapted to retain multiple small foodstuffs such as cheeses, hors d'oeuvres, sandwiches, and the like. In each position of the tray, the relationship of the cover to the tray remains the same.

It should be appreciated that while the carrier is referred to as a carrier for pastry, items of this type are used to carry, display and serve a variety of foodstuffs, including cakes, cheeses, pies, sandwiches, etc.

DESCRIPTION OF PREFERRED EMBODIMENTS

Figure 1:
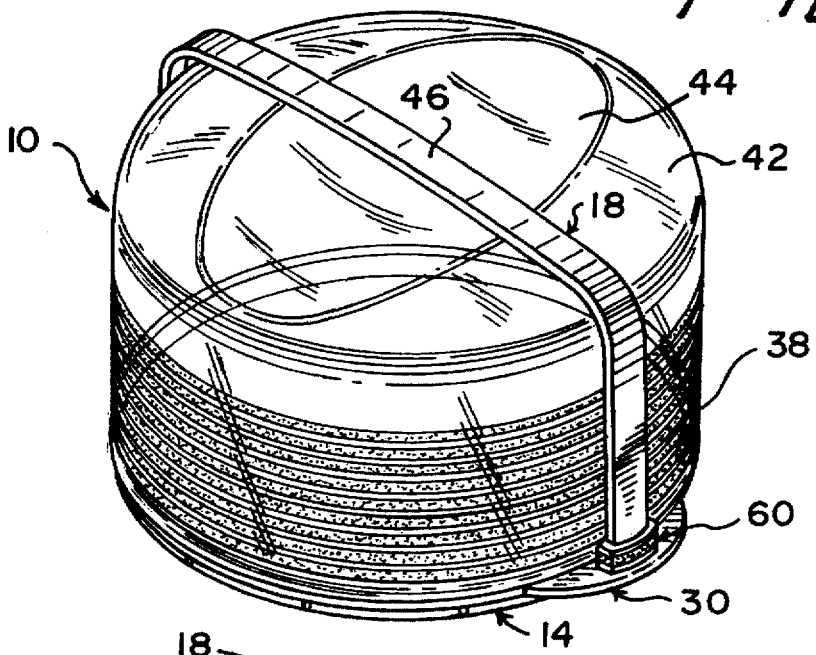
FIG. 1 is a perspective view of the carrier of the invention with the cover closed.

Referring now more specifically to the drawings, the carrier 10 comprises only two major separable components, the tray 14 and the integrally combined cover 16 and handle 18. While not limited thereto, the tray 14 has been illustrated as round, and the cover, in accordance therewith, as generally cylindrical. As will become apparent, the unique features of the invention are equally adapted for accommodating carriers of other configurations.

The tray 14 includes opposed planar faces 20 and 22 and is invertible for use of either face as a support surface for the foodstuff. The face 20 is provided with a continuous peripheral slightly raised rolled edge 24 which, while tending to retain foodstuffs on the surface, is sufficiently low as to allow for easy sliding of cakes or pies onto the surface 20, and is also low enough for comfortably cutting such goods.

Figure 2:
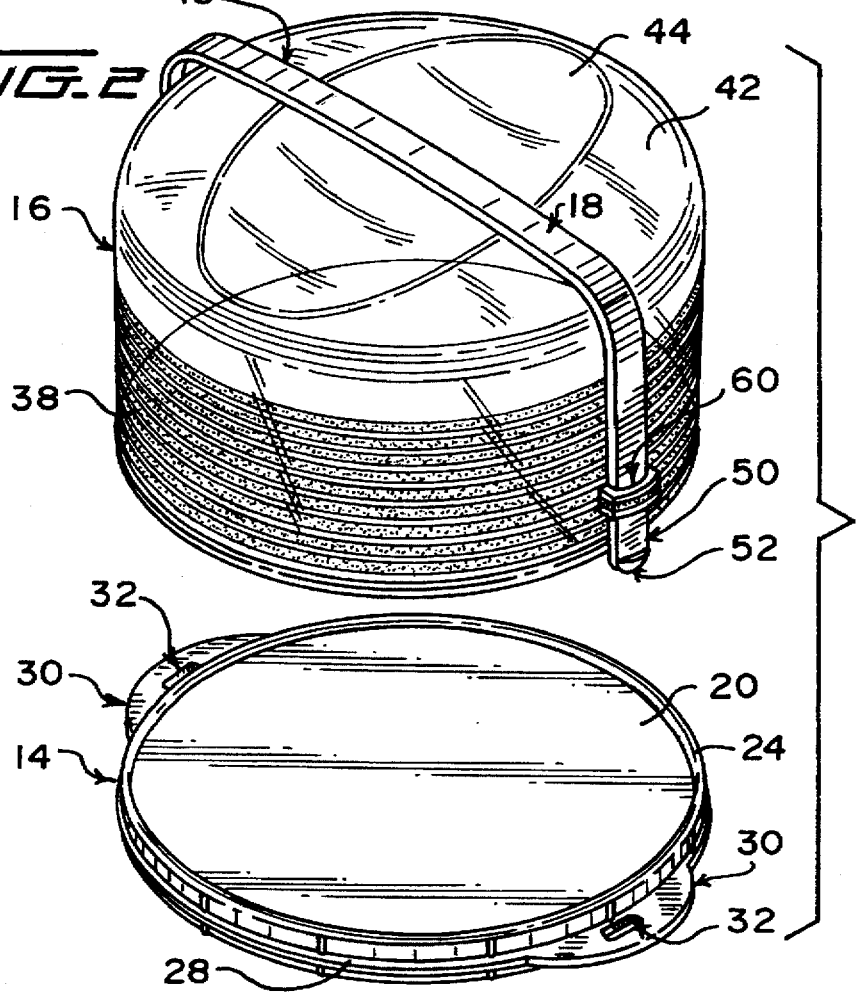
FIG. 2 is an exploded perspective view of the two components of the carrier, the tray and the combined cover handle.
Figures 3, 4, 5:
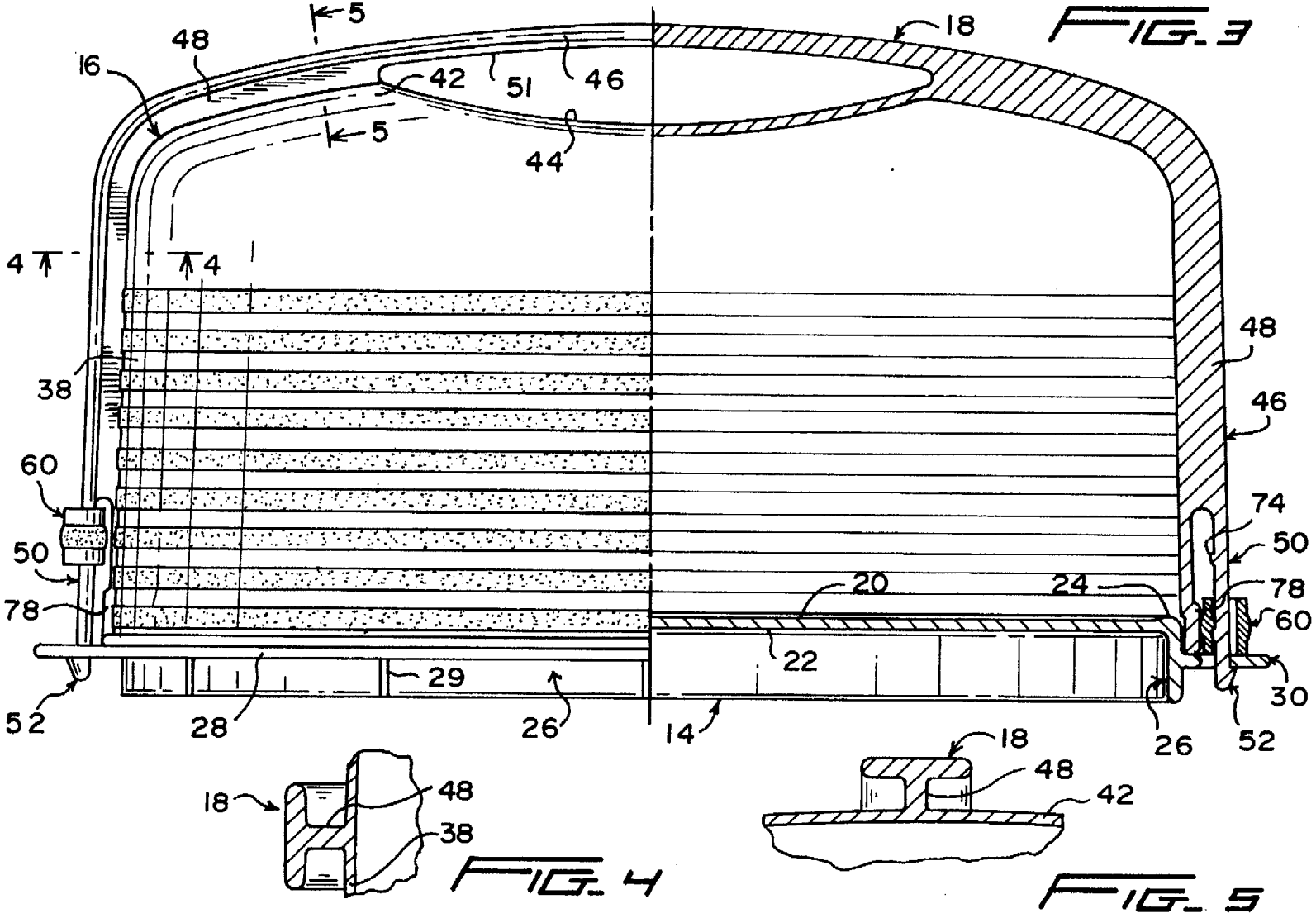
FIG. 3 is an enlarged elevational view of the carrier with a portion thereof in cross-section and illustrating the handle relationship to the cover and tray.
FIG. 4 is an enlarged cross-sectional detail through a vertical portion of the handle and taken substantially on a plane passing along line 4—4 in FIG. 3.
FIG. 5 is an enlarged cross-sectional detail through a portion of the handle extending across the top of the cover and substantially on a plane passing along line 5—5 in FIG. 3.

The surface 22 is in turn surrounded by a relatively deep peripheral flange 26, thus providing substantial side support when the tray is used for carrying, storing or serving smaller foodstuffs such as hors d'oeuvres, sandwiches, and the like. Approximately mid-height on the flange 26, which in conjunction with the rolled edge 24 provides a smooth peripheral outer surface, is an integral annular outwardly projecting flange 28 adapted to receive and support the lower edge of the cover 16 as shall be explained subsequently. As suggested in FIGS. 2 and 3, the flange 26 can be provided with spaced vertical strengthening ribs 29.

At diametrically opposed portions of the tray 14, the support flange 28 is arcuately outwardly enlarged to define a pair of handles 30 of a predetermined thickness corresponding to that of the support flange 28. Each of the handles 30 in turn has an elongate aperture or slot 32 formed therethrough and extending lengthwise over a minor portion of the arc of the adjacent peripheral edge of the tray. With reference to the enlarged detail of FIG. 6, it will be noted that the inner edge 34 of each slot 32 is slightly arcuate or rounded, while the outer edge 36 is flat or planar for reasons to be explained subsequently.

The cover 16, indicated as substantially cylindrical to conform to the illustrated round tray 14, has the side wall 38 thereof tapering slightly upward from a free peripheral lower edge 40 to an integral upwardly domed fully closed top 42.

The top 42 has a generally elliptical elongate recess 44 defined therein and extending diametrically thereacross for the accommodation of a hand used to grasp the handle 18. The recess 44, as illustrated, is preferably transversely arcuate.

The handle 18 is formed principally of a wide substantially rigid and generally flat strap 46. The strap 46 extends diametrically across the cover 16 in slightly outwardly spaced relation thereto and at right angles to the cover recess 44. The strap 46 is integrally and rigidly joined to the cover by a pair of webs 48, integral with the under surface of the strap centrally therealong. Each web 48 extends from an outer side edge of the recess 44 across the top 42 of the cover and vertical along the corresponding portion of the cover side wall 38 for a major portion of the height of the side wall 38. The strap, beyond the lower ends of the webs 48 forms vertical end portions 50 which terminate below or slightly beyond the lower edge 40 of the cover. As will be appreciated from the drawings, that portion of the handle strap 46 which spans or extends across the recess 44 defines a hand grip which, in combination with the hand accommodating recess 44, allows for an easy grasping of the handle for a selective raising of the entire carrier or the cover independently of the tray. For a rigidification of this central gripping portion of the hand strap 46, the strap, for the transverse extent of the recess, can be provided with a central shallow depending rib 51 which in effect constitutes a partial continuation of the webs 48 to the opposite ends thereof.

The opposed free lower ends of the handle strap 46 each defines a latch element and is laterally outwardly enlarged, as at 52, to provide an upwardly directed shoulder 54. The outer face 56 of the enlarged lower end of each strap end is inclined outwardly or upwardly to provide a guide surface. Noting FIG. 6 in particular, these enlarged strap ends 52 extend sufficiently below the lower peripheral edge 40 of the cover 16 as to engage through the opposed tray slots or latch keepers 32 as the cover edge 40 sits on the ledge or seat defined by the peripheral tray flange 28. The inclined surface 56 on each enlarged end 52 guides the end through the corresponding slot 32, and the shoulder 54 engages beneath the tray handle 30 radially outward of the slot 32 as the outer face of the strap 46 engages against the planar outer face or edge 36 of the slot 32. This engagement, due to a slight inwardly flexing and outward biasing of the lower end portions 50 of the strap 46 will preferably be automatic as the cover is positioned on the tray. However, this engagement, while properly orienting the cover on the tray, will not be sufficient to prevent accidental release. In other words, it is conceivable that, should the latch assembly rely solely on the resiliency of the handle strap end portions, heavy loads, particularly if such loads shift within the container, could cause accidental release, as could an unintentional hitting or bumping of the sides of the container, particularly at the vertical sections of the strap.

Accordingly, a simple although unique and highly effective means is provided for manually locking the handle, and hence the cover, to the tray assembly until intentionally manually released.

Pursuant thereto, a locking sleeve or collar 60 is slidably mounted, for vertical adjustment, on the vertically elongate lower end portion 50 of each of the opposed vertical extents of the handle strap 46. Noting FIGS. 6–9 in particular, each collar 60 engages about the corresponding strap portion 50, conforming rather closely to the strap portion to allow for free vertical sliding thereon while precluding any significant lateral shifting, either in the plane of the strap or transverse thereto, of the collar 60 relative to the strap portion 50. As such, the inner wall 62 of each collar substantially parallels the inner face 64 of the strap portion 50. The opposed end walls 66 of each collar in turn similarly substantially parallel the opposed side edges 68 of the strap 50. The outer wall 70 of each collar is outwardly arced for the full height thereof to define a space 72 between the outer face of the corresponding strap portion 50 and the wall 70 which is at a maximum along the vertical central portion of the wall 70. This space 72, as can be best appreciated in FIG. 6, allows for the accommodation of the enlarged end 52 on the corresponding strap portion therethrough to allow for a positioning of the collar 60 on the end portion 50. In other words, each collar is merely upwardly introduced over the enlarged lower end 52 into free sliding reception on the end portion 50.

The collars 60, when received on the strap end portions 50, are initially releasably retained in a stored position toward the upper ends of the portions 50 immediately below the end of the corresponding web 48. To retain the collars 60, each strap portion 50, on the inner face thereof, includes an upper projection or abutment 74 defining an upwardly directed shoulder which receives a corresponding projection 76 integral with the inner face, that face directed toward the end portion 50, of the inner wall 62 of the collar 60. This relationship will be best noted in FIGS. 8 and 9. It is to be appreciated that the inherent resilient flexibility of the substantially rigid collar 60 is such as to allow for a snap locking of these abutments or projections 74 and 76 and a similar manual release thereof.

When both collars 60 are in their upwardly stored position, the extending end portions 50 of the handle strap, due to inherent resilient lateral flexibility thereof, are free for introduction into the tray slots 32 for an engagement of the enlarged ends 52 beneath the tray handles 30 adjacent the slots 32.

The purpose of the collars 60 is to releasably lock the strap ends to the tray handles. Accordingly, a pair of vertically elongate cam or camming members 78 are integrally formed on the vertical wall 38 of the cover and project outwardly therefrom in alignment with the vertical centers of the corresponding collars 60. Each cam 78 extends upward from the lower edge 40 of the cover and projects radially outward a distance sufficient as to engage and outwardly cam the corresponding collar 60, and hence the encircled strap end portion 50 to effect a positive movement of the shoulder 54 on the enlarged end 52 of the strap portion 50 outward of the corresponding tray slot 32 for a positive engagement beneath the tray handle 30. When so engaged, radial inward movement of the strap end portion 50, and disengagement of the enlarged end 52, is effective precluded until such time as the locking collar 60 is manually moved upward and disengaged from the cam 78.

Figure 6:
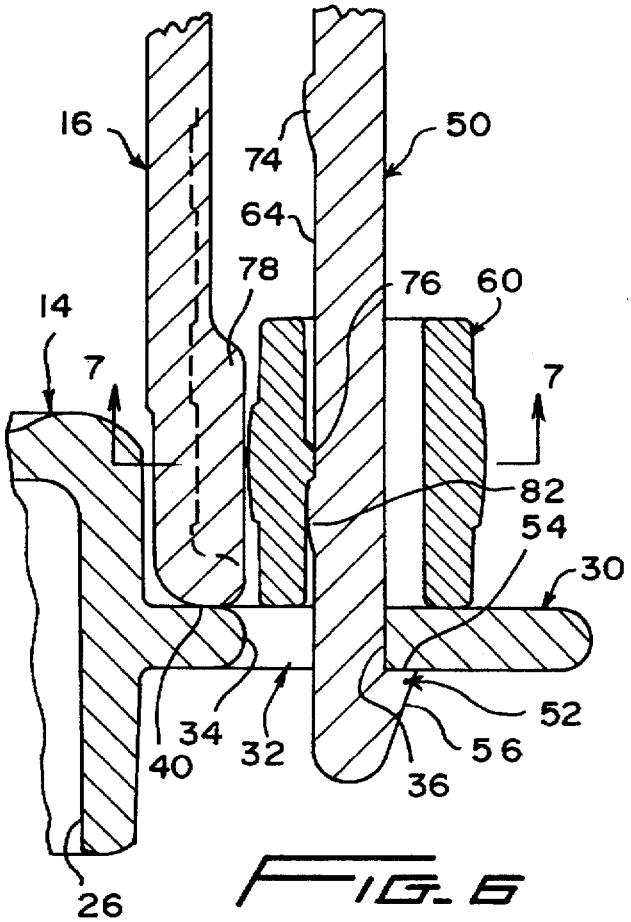
FIG. 6 is an enlarged cross-sectional detail through the lock assembly with one handle end locked to the tray.
Figure 8:
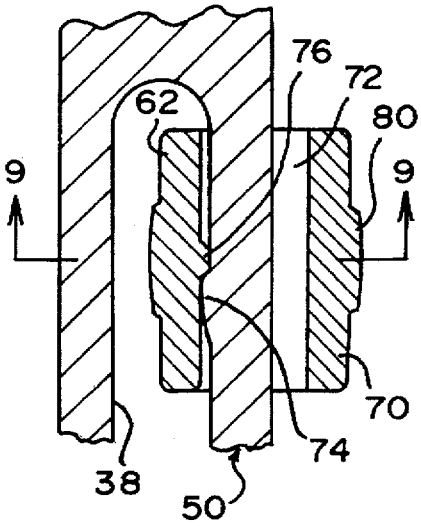
FIG. 8 is an enlarged cross-sectional detail with the locking collar in its release or stored position.
Figure 7:
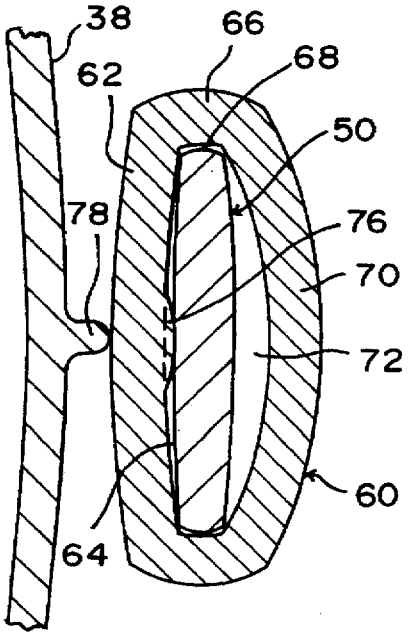
FIG. 7 is a cross-sectional detail substantially on a plane passing along line 7—7 in FIG. 6 and illustrating the locking collar in its locking position.
Figure 9:
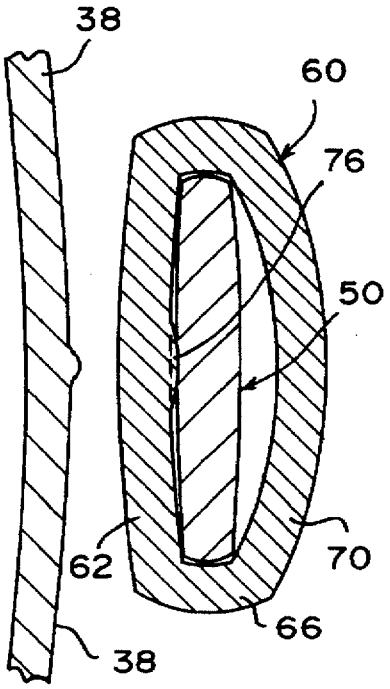
FIG. 9 is an enlarged cross-sectional detail taken substantially on a plane passing along line 9—9 in FIG. 8 with the collar in its released position.

With reference to the enlarged detail of FIG. 6, it will be appreciated that each cam 78 is vertically elongate and of a height as to provide for a positive pressure on the collar 60 even should the collar 60 slightly shift due to vibration, carrying motion, and the like. It will also be appreciated that the upper end of each of the cams 78 is slightly tapered to facilitate engagement of the downwardly moving collar 60 therewith. Finally, it will be seen that the collar 60 is provided with an exterior integral band 80 which facilitates the manual gripping and manipulation of the collar 60 and provides a concentrated bearing area between the collar 60 and cam 78 to enhance the locking effect.

With continued reference to FIG. 6, it will be noted that a second abutment or projection 82, similar to the projection 74, is formed on the inner face 64 of each strap end portion 50 at a point slightly below mid-height of the cam 78 and acts a lower stop for the collar 60 with the collar 60 projection 76 engaging thereagainst. This engagement will correspond to the position wherein the collar is in its cammed and locking orientation. The projections 76 and 82 will normally engage as the collar 60 seats on the upper surface of the tray handle 30 and as the cam 78 fully engages with the collar 60 or encircling band 80 thereon. It will also be appreciated that the lower projection 82, and its relationship with the opposed cam 78, acts to ensure a positive positioning of the collar 60 relative to the cam 78 in those situations wherein the collar 60 may not actually seat on the upper surface of the tray handle. Should it be necessary to remove the collars 60 for cleaning or replacement, the inherent nature of the materials used will allow a manual forcing of the collars over the projections 52.

In use, when the cover is removed, the collars 60 will normally be retracted and releasably locked in the stored position by the cooperating projections 74 and 76. To mount the cover, the lower latch element ends 52 of the handle strap are aligned with the tray keeper slots 32, and the cover moved downwardly with the lower ends moving through the tray slots. These ends 52 will initially inwardly cam due to the inclined faces 56 therein, and subsequently snap outward due to the inherent flexible resiliency of the end portions 50. As a final step in mounting the cover, and to ensure a positive interlocking of the handle and cover to the tray, the collars 60 are slid downwardly and, upon engaging the cams 78, outwardly shifted to outwardly flex the handle end portions therewith to effect a positive locking of the enlarged ends 52 beneath the tray handles 30 immediately outward of the corresponding tray handle slots 32. Release of the handle and cover can now only be effected by a manual retraction of the locking collars 60.

When it is desired to remove the cover, one need merely upwardly slide the two locking collars 60 to their stored position, slightly inwardly flex the handle strap end portions 50, and upwardly lift the cover from the tray. The actual locking and release of the latch assembly of the tray, cover and handle involves, because of the uniqueness of the components of the lock assembly, a simple manual movement which requires little manual dexterity and yet provides for a troubled free and positive locking relationship between the handle, cover and tray.

The integral formation of the handle with the cover along a major portion of both the horizontal and vertical extent of the cover, that is along the opposed sides of the cover side wall and across the top of the cover, provides a substantial degree of rigidity to the handle and the cover as well as to the assembled carrier. The cover is rigidly stabilized relative to the handle, and the handle in turn releasably locked to the tray in a positive relationship precluding accidental disengagement.

The foregoing is illustrative of the features of the invention, and while a single embodiment has been illustrated, it is to be appreciated that the invention is not to be limited to the specific embodiment illustrated.

We claim:

1. A carrier for foodstuffs comprising a tray, a cover and a handle overlying said cover and selectively lockable to said tray with said cover interposed therebetween; said tray including a support surface, said cover including a top and a peripheral side wall depending from said top for engagement with said tray about said support surface, said handle extending transversely across said cover top and continuing along and substantially parallel to said peripheral side wall at opposed portions of said cover, cooperating latch means on said handle and tray for releasable latching engagement upon mounting of said cover and said handle on said tray, and lock means manipulable independently of said latch means for releasably locking said latch means against disengagement.

2. The carrier of claim 1 wherein said handle has opposed, free, lower ends, each end defining a latch element with an upwardly facing shoulder thereon, said tray having a pair of latch keepers therein receiving corresponding ones of said latch elements upon mounting of said cover and said handle on said tray, said latch elements and keepers defining said latch means, said lock means engaging said handle adjacent each end thereof and being manually moveable for laterally shifting a corresponding latch element into a locked position relative to its keeper wherein withdrawal of the latch element from the keeper is precluded until such time as said lock means is withdrawn.

3. The carrier of claim 2 wherein said lock means comprises a pair of sliding members, one slidably mounted on said handle along a handle portion immediately inward of each handle end, and a pair of cams mounted on said cover, one in alignment with each of said handle portions and in the path of movement of the corresponding sliding member, each sliding member, upon engagement with the corresponding cam, being laterally outwardly biased, and in turn outwardly biasing the corresponding handle end latch element into latched and locked engagement with the corresponding keeper wherein withdraw of the latch element is precluded.

4. The carrier of claim 3 including a pair of retainers on said handle, each retainer being inwardly spaced from one of said handle lower ends, each retainer being in the path of movement of the corresponding sliding member and selectively engaging and retaining said sliding member remote from the corresponding end.

5. The carrier of claim 4 wherein each sliding member comprises a collar encircling the corresponding handle portion.

6. The carrier of claim 5 wherein said handle portions of said handle are laterally spaced outward from said cover side wall and are laterally resiliently flexible relative thereto.

7. The carrier of claim 5 wherein each of said collars is configured for longitudinal engagement over and beyond the corresponding handle end, and a second retainer inward of each handle end and proximate thereto for engaging the corresponding collar and releasably retaining the collar against withdraw from said handle.

8. The carrier of claim 6 wherein said handle engages said cover along substantial portions of said top and side wall.

9. The carrier of claim 8 wherein said handle is integral with said cover along said engaged portions.

10. The carrier of claim 9 wherein said cover includes a recess defined in and across said top, said handle extending transversely over said recess and defining, in cooperation with said recess, a hand grip.

11. The carrier of claim 1 wherein said handle engages said cover along substantial portions of said top and side wall.

12. The carrier of claim 11 wherein said handle is integral with said cover along said engaged portions.

13. The carrier of claim 1 wherein said cover includes a recess defined in and across said top, said handle extending transversely over said recess and defining, in cooperation with said recess, a hand grip.

14. A carrier for foodstuffs comprising a tray, a cover and a handle overlying said cover and selectively lockable to said tray with said cover interposed therebetween; said tray including a support surface, said cover including a top and a peripheral side wall depending from said top for engagement with said tray about said support surface, said handle extending transversely across said cover top and continuing along and substantially parallel to said peripheral side wall at opposed portions of said cover, cooperating latch means on said handle and tray for releasable latching engagement upon mounting of said cover and said handle on said tray, a recess defined in and transversely across said cover top, said handle extending transversely over said recess and joined to said top and cover side wall at each side of said recess for portions of said top and said side wall.

15. The carrier of claim 14 wherein said handle is integral with said cover along said engaged portions.

16. The carrier of claim 15 wherein said handle includes opposed lower end portions laterally spaced outward from said cover side wall and laterally resiliently flexible relative thereto, said handle lower end portions including free lower ends defining latch elements of said latch means.

* * * * *